US005345989A

United States Patent [19]

Brophy

[11] Patent Number: 5,345,989

[45] Date of Patent: Sep. 13, 1994

[54] DUST GUARD MOUNTING

[76] Inventor: Dennis M. Brophy, 524 Green St., Boylston, Mass. 01532

[21] Appl. No.: 134,438

[22] Filed: Oct. 12, 1993

Related U.S. Application Data

[63] Continuation-in-part of Ser. No. 18,571, Feb. 17, 1993, abandoned.

[51] Int. Cl.[5] ..... A47H 23/00

[52] U.S. Cl. ..... 160/354; 160/368.1

[58] Field of Search ..... 160/368.1, 354, 327, 160/330; 454/169, 170; 52/202, 203, DIG. 13

[56] References Cited

U.S. PATENT DOCUMENTS 2,255,725 9/1941 Trescher .
3,251,399 5/1966 Grossman .
3,480,069 11/1969 Handwerker .
4,100,957 7/1978 Shelton .
4,128,977 12/1978 Schubeis .
4,249,589 2/1981 Loeb .
4,399,640 8/1983 Porter .
4,768,320 9/1988 Weller .
4,782,883 11/1988 Braiotta .
4,874,028 10/1989 Lynch .
4,904,384 12/1990 Pacione .

FOREIGN PATENT DOCUMENTS 2403004 9/1977 France .

*Primary Examiner*—Blair M. Johnson
*Attorney, Agent, or Firm*—Shlesinger Arkwright & Garvey

[57] ABSTRACT

A barrier curtain and carrier combination is shown for temporarily mounting the curtain on the edge of the wall surrounding an unobsrtructed opening in the wall of a building during a rehabilitation or construction project.

11 Claims, 2 Drawing Sheets

Fig. 8
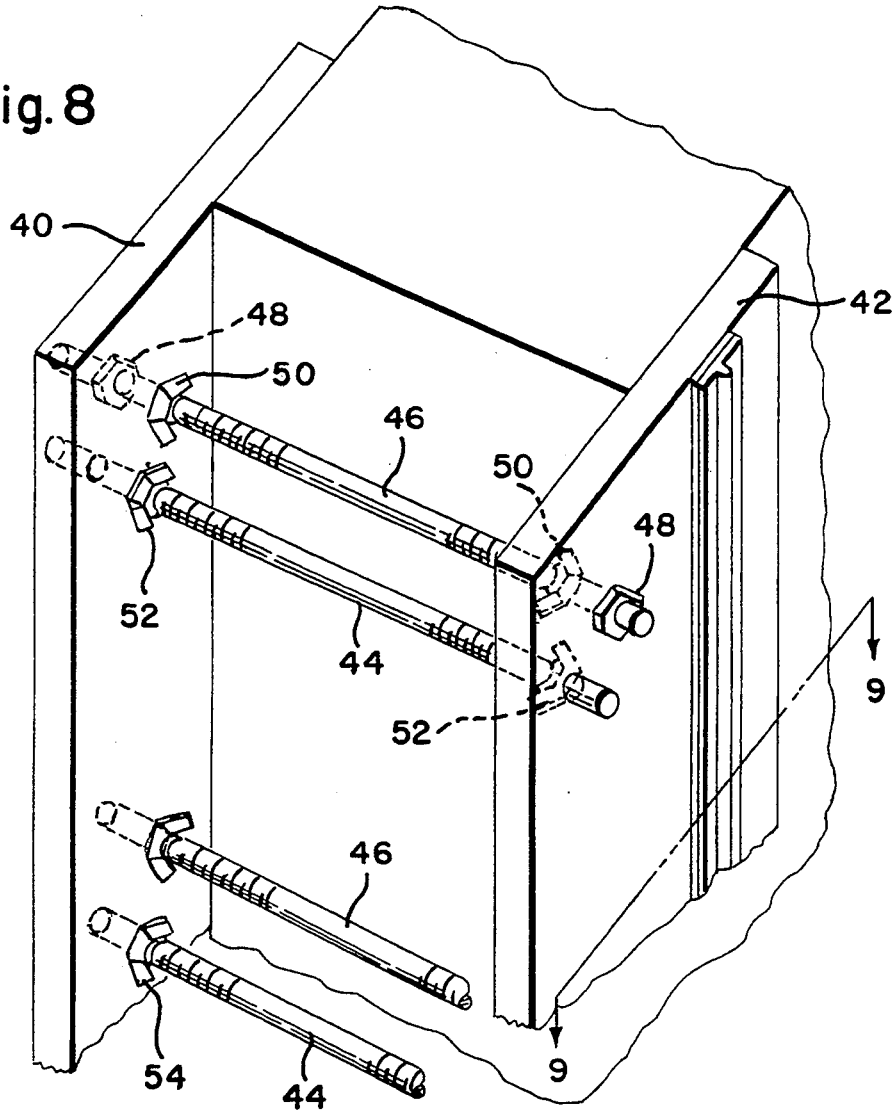
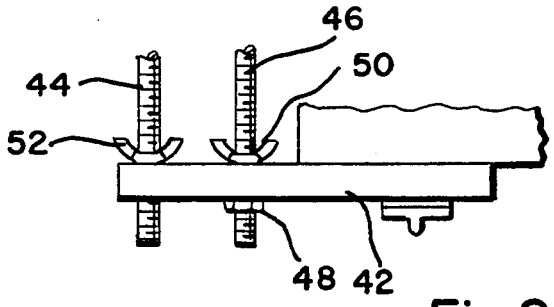
Fig. 9
Fig. 10
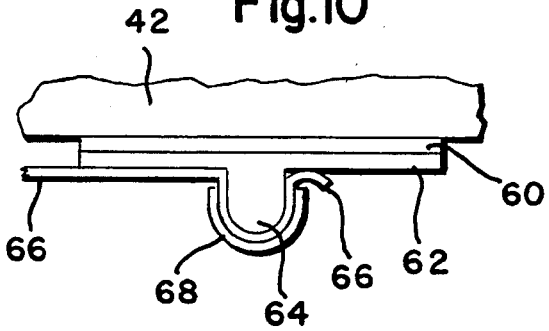

DUST GUARD MOUNTING

RELATED CASE

This application is a continuation-in-part from my prior application S.N. 08/018,571 filed Feb. 17, 1993, abandoned.

This invention relates to a means for mounting a dust guard over an opening in a wall at a construction site and more particularly to a means for temporarily attaching mounting means for supporting a dust shield or the like on the edges of the wall surrounding a door opening or the opening at an archway or other opening in a wall for the purpose of temporarily supporting a dust shield or curtain over the opening while construction is progressing behind the curtain.

BACKGROUND

At construction projects and particularly during domestic remodeling projects, it is always desirable to seal off an unobstructed opening such as a doorway or archway between one room and another of a home to prevent dust from flowing from the construction zone into the rooms beyond that area or to block out air flow from the one area to another area while work is progressing. Usually a curtain is draped over the opening and various means are used to hold the draped curtain in place. Nails or tacks are commonly used or sometimes adhesive strips are attached to the curtain and wall to hold the curtain in place. The nails of course leave holes in the wall or molding surrounding the opening that must subsequently be repaired while when the adhesive tape is being removed after the project is finished, the adhesive strip often pulls paint or wall paper off of the wall or door jamb to which the tape adheres requiring the repapering of or repainting of the affected area.

BRIEF DESCRIPTION OF THIS INVENTION

The herein disclosed curtain support device makes use of temporarily mounted carrier means for supporting the curtain over such an unobstructed opening which curtain is to be attached upon means supported on the edges of wall that define the opening in the wall for surrounding substantially the entire opening for a door or an archway or the like, the carrier having means fixed thereto that cooperate with means fixed to the periphery of a curtain that is to be mounted over the opening. The curtain carrying structure preferably is made up of a plurality of U shaped elements that can be quickly fitted to the wall surfaces by spreading the legs of the U to be fitted around and be supported on the wall edges that define the opening to be covered. The legs of the mounted carrying elements have a sufficiently tight engagement with the surface of the wall to hold the curtain taut when the curtain is mounted on the carrier to hold it in place and the curtain is then adapted to contain dust or seal the opening against an air flow from passing through the covered opening. The carrier means that is mounted on the wall edges incidentally also serves to protect these edges from damage during the progress of the construction project.

After the construction project has been completed the curtain and carriers may be removed from engagement with the wall edges that surround the opening to be stored for reuse on the next project where they might be needed.

IN THE DRAWINGS

FIG. 8 is a perspective view of an alternate form of this invention;

FIG. 9 is a detailed sectional view of the structure shown in FIG. 8 taken on line 9—9 of that FIG.; and FIG. 10 is an enlarged view of a curtain mounting means that can be used with this alternate form of the invention.

DETAILED DESCRIPTION

It frequently happens during the performance of work on a remodeling project that an objectionable dust is created that should be prevented from passing through an unobstructed doorway or opening for an archway into other rooms adjacent the work area. The removal of any paint and especially a lead paint or refinishing of a floor that requires a sanding operation, are examples of particularly objectionable dusts that must be contained. Also it may be desirable in cold weather for example, to prevent cold air from flowing from an unused or unheated room into another adjacent room. These and other instances make it necessary to provide a means for temporarily mounting a shield or dust curtain for example over an otherwise unobstructed opening from one room to another adjacent room.

By making use of the curtain carrying elements illustrative of this invention it is possible to mount a suitable curtain over the unobstructed opening to positively seal that opening without in anyway damaging the surrounding wall edges upon the removal of the curtain from its carrier after the necessity for closing the opening has passed.

Figure 1:
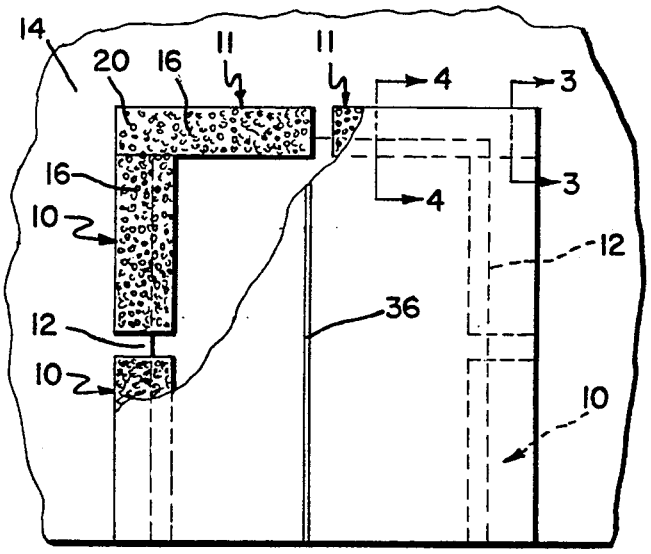
FIG. 1 is an assembly view showing the preferred form of a plurality carriers mounted around an unobstructed opening for an archway with a curtain that is partly broken away mounted thereon.
Figure 5:
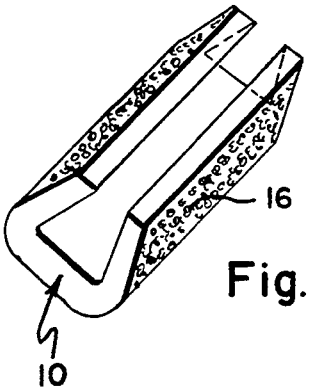
FIG. 5 is a perspective view of a preferred form of the curtain carrying means before its legs are spread for mounting on the wall surrounding an opening.

Referring to FIG. 1, a plurality a curtain of carrying elements 10 and 11 are shown mounted around an unobstructed opening for an archway 12 in a wall 14. The elements 10 can be made in any desired length but it will be found that the most useful dimensions therefor are about three feet and four feet. Preferably the bodies of these curtain carrying elements are made of a foamed plastic composition in the order of about one to two inches thick. The body of the carrier should be fairly stiff and of course self sustaining with a good degree of resilience. The elements are cast with a generally U shaped crossection with the legs of the U turned inwardly as shown in FIG. 5 so that when they are spread apart and fitted over the edge of a wall surrounding an opening. The resilience of the legs will be sufficient to engage the carrier element snugly in place.

The surface of each carrier element is preferably covered with either one or the other of the cooperating elements 16 of a Velcro fitting. This may be accomplished by attaching adhesive strips onto most of the exposed surface of the elements 10 and 11 or possibly in the manufacture of the plastic elements, the Velcro loops 16 for example may be cast in the desired surface areas of each of the elements.

Figure 2:
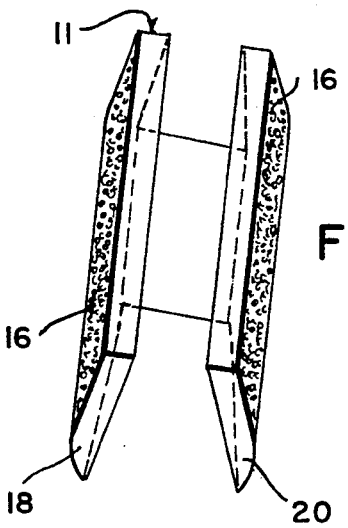
FIG. 2 is a perspective view of an element designed to used it the top of each of the corners of the archway opening.
Figure 3:
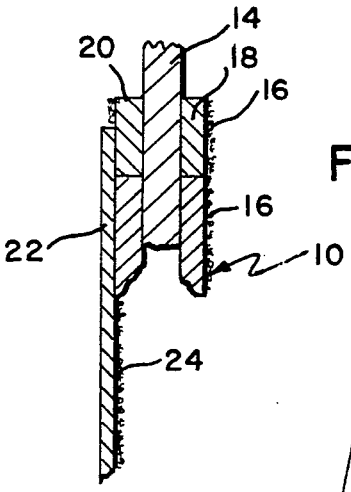
FIG. 3 is a sectional view taken on line 3—3 of FIG. 1.

By making up the carrier elements in three feet and four feet lengths, it is possible to fit a combination of these elements of different lengths onto the wall edges that surround the archways of most conventional home construction where the doorway heights are usually standardized at one of the following sizes; six and one half feet, six feet and eight inches or seven feet. The elements 11 can be produced in two feet or three feet lenghths and have a special end structure. The carriers 11 are of identical constrution and are adapted to be fitted across the top of the opening as shown in FIG. 1. Referring to FIGS. 1 and 2, the left end carrier 11 is shown with two earlike extensions 18 and 20 of the side walls of the U shaped body, the ears having a length to cover the top end of the side wall carrier element 10 that butts up against the bottom of the ear 20 as there shown. A coresponding fit is made between the right hand carrier mounted across the top of the arch and the uppermost end of the vertical carriers attached to the side edge of the wall along the right hand of the opening as is shown in FIG. 3.

Figure 4:
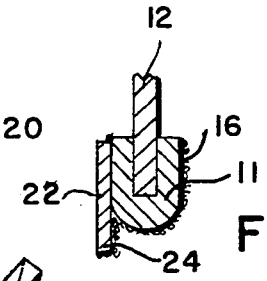
FIG. 4 is a sectional view taken on line 4—4 of FIG. 1.

After all the carrier elements have been fitted into their securely fixed positions around the opening as shown in FIG. 1, a curtain 22 is cut to size having a perimeter to just fit around and to cover the edges of the opening to an extent to permit it to extend over the area covered by the carriers elements attached to the edges of the wall at the opening. Strips of Velcro elements 24 are adhesively or otherwise attached to one side of the curtain around three sides of its periphery which Velcro elements are adapted to coact with the Velcro elements 16 fixed to the carriers as shown in FIGS. 3 and 4. Since the carriers cover substantially the entire length of the exposed wall edges that surround the door or archway opening, the Velcro parts 24 attached around perimeter of the curtain can be engaged with the Velcro parts 16 fixed to the carriers 10 and 11, to form dust tight seal to cover the opening. It should be noted that if any substantial gap remains between the ends of the carrier elements attached to the wall edges, a suitable length of a carrier can be cut to fill in the gap to ensure a complete closure of the opening when a curtain is fitted to and mounted on the carriers.

The curtain may be provided with a zipper 36 for opening and closing a slit at the middle of the curtain if desired. Any suitable material such as a polyvinyl plastic sheet or canvas or the like may serve for the curtain.

While a Velcro system for engaging the curtain on the carriers has been shown as a preferred form of attachment, other means may be found feasible such as a series of magnetic elements that attract one another may be mounted on the respective elements to provide a sufficiently secure temporary mounting of the curtain on the carriers. A reusable temporary adhesive strip might also be used in some cases.

Figure 7:
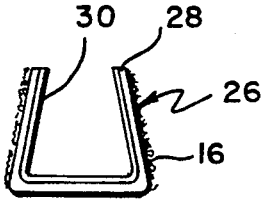
FIG. 7 is and end view of still another form of a temporarily attachable curtain carrying means.

The carriers 10 and 11 may preferably be made of an extruded plastic material as mentioned above, which if necessary can be cut to fit around the entire length of the exposed edges at the arch or doorway being covered. It is also suggested that these means may be constructed of an aluminum or other resilient metal backing the inner surface of the generally U shaped crossection of which would preferably be lined with a suitable soft layer of an anti-skid material to prevent any scratching of the surface of the wall edge to which the carrier is fitted. Such an alternate carrier structure 26 is shown in FIG. 7. The metal or plastic body 28 which is shown coated with Velcro means 16, is provided with a foamed plastic or other soft anti-skid liner material 30.

Figure 6:
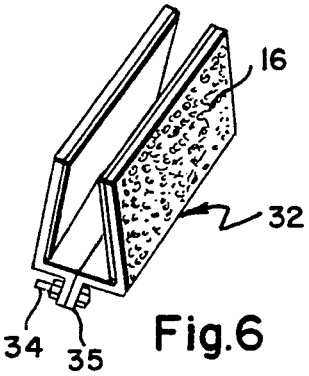
FIG. 6 is a perspective view of an alternate form of a temporarily attachable curtain carrying means.

Another form of a carrier element 32 is shown in FIG. 6 that could be used on the edge of a thicker wall such as an unobstructed opening in an outer wall of a building or with a wall having a nonstandard thickness. If two L shaped bars of the proposed three and four feet lengths having resilient, slightly inturned legs, are provided, they can be fitted along the opposite sides of the wall edges around the wall opening and the-two mating bar members can then be firmly fixed onto these edges by several bolts 34 fitted through ears 35 integral with the bars and spaced along the length of the backsides of the bars. A suitable protective liner is also integral with the bars to protect the wall edges against any damaged that might otherwise be produced by the mounting of these bars on the wall edges.

An alternate form of the invention is shown in FIG. 8 wherein two legs 40 and 42 of a generally U shaped device are formed of two planar sheets or plates that may be made of a plastic material, aluminum or some other similar material that will remain substantially rigid when the device is mounted on an edge of an unobstructed wall opening. These two legs are formed into what can be considered a U shaped means upon being operatively connected by several sets of parallel spaced apart bolt elements 44 and 46 all of which setstaken together constitute the web element of the U shaped mounting device.

As shown in FIG. 8, in each set of bolts, the bolt 46 closest to the edge of the wall opening is held firmly in place at one end by the head of the bolt or by a nut on the outside of plate 42 and a wing nut 50 on the inside of that plate. The opposite end of each bolt 46 is similarly attached to the plate element 40 with a nut on the outside and a wing nut both of which may be adjusted to form a fixed fulcrum that holds the plates 40 and 42 close to but spaced slightly apart from the opposite sides of the edges of the wall opening upon which the device is being mounted. The other bolts 44 in each pair of bolts is provided with wing nuts 52 and 54 that engage against the inside of the plate elements 42 and 40 respectively.

This construction which constitutes a U shaped mounting means in its essence can be fixedly attached to the wall edges that define an unobstructed wall opening by turning the wing nuts 52 and 54 on each of the bolts 44 to drive these outer ends of the plates outwardly, to turn about the fulcrum by forcing the exposed edges of the plates 40 and 42 to be spread apart and force the inner ends of these plates to engage tightly onto the opposite sides of the wall edge over which each mounting device has been placed whereby to fixedly mount them on the edges of the wall opening.

The inner surfaces of the plates 40 and 42 are preferably covered with a suitable cushioning material to protect any surface upon which the device is being mounted from being marred by the engagement of this form of the mounting means on the wall edges As above indicated the plate elements 40 and 42 must be made of a material that is stiff enough so that after the bolts have been suitably adjusted, the plates will engage the wall surfaces with a fair degree of pressure to hold the mounting means snugly in place.

It is apparent that the role of the bolts 44 and 46 may be reversed and the bolt 44 be used to provide the fixed fulcrum by placing wing nuts 52 and 54 on the outside of the plates 40 and 42 and the other nuts on the inside of these walls and the adjusting nuts on bolt 46 on the outsides of the plates 40 and 42.

Means for quickly and securely attaching the curtain on the mounting means is best seen in FIGS. 9 and 10. The attaching means can be temporarily affixed to one side of the mounting means supported on the the edges of the opening in a position to hold a dust curtain over the opening. For this purpose the plate 42 shown in FIG. 10 for example, has a sticky backed strip of Velcro means attached thereto. A second plastic strip 62 having cooperating Velcro elements fixed thereto is adapted to be mounted over the strip 60. The strip 62 is formed with a ridge 64 integral therewith over which the curtain material such as a polyvinyl sheet of plastic 66 may be draped. The curtain material 66 can then be temporarily attached to the ridge 64 on each of the mounting elements fixed to the edges of the wall opening by the placement of a resilient U shaped plastic strip 68 over the curtain draped over the ridge 64 to crimp the curtain in place over the ridge to hold it securely stretched over the unobstructed wall opening similarly to the showing of the curtain 22 depicted in FIG. 1.

It is apparent that each of the plates 40 and 42 could be manufactured with an integral ridge 64 extending lengthwise along its outer surface. The Velcro attachment means does however provide a more serviceable temporary attaching means for many uses.

The plates 40 and 42 are made of a size to be easily manipulated and can be of the lengths described above to permit them to be combined in different combinations in order be fitted around the edges of the standard archway dimensions of domestic and commercial structures. Either two or more pairs of connecting bolts can be used on each one of the assembled pairs of these plates to form the U shaped device for mounting the assembled plates over the wall edges.

The above description illustrates the preferred form of my invention. It is possible that modifications thereof my occur to those skilled in the art that will fall within the scope of the following claims.

I claim:

1. A curtain for mounting on a wall in a building having an unobstructed opening defined by wall edges having front and back sides having finished surfaces such as for a door or archway in a building and a mounting means for temporarily holding the curtain over the opening comprising curtain means constructed and arranged to be temporarily attached to said wall edges around said opening without marring the surface of the front and back sides of said wall edges, said mounting means taking the form of a plurality of generally U shaped elements in crossection having resilient arms that freely extend from a connecting back, said arms of the mounting means being adapted to be temporarily engaged over and supported upon said front and back sides of said wall edges that define said opening, a plurality of said mounting means being adapted to be engaged on said wall edges to surround said opening, each of said U shaped mounting means supporting holding means on at least the outer surfaces of at least one of the arms of said U-shaped element, a curtain cut to a size having a perimeter to cover said opening, and cooperating holding means attached to the perimeter of said curtain to coact with said holding means supported on said U shaped mounting means when said plurality of holding means have been engaged upon said wall edges whereby said curtain may be temporarily attached to said holding means to cover said opening.

2. A curtain and mounting means as in claim 1 wherein said U shaped mounting means has an outer stiff but resilient backing structure with a softer cushion material lining the inner surface of the U shaped means.

3. A curtain and mounting means as in claim 2 wherein said U shaped means has a foamed plastic inner surface.

4. A curtain and mounting means as in claim 2 wherein said U shaped means has a metal backing with a foamed plastic inner surface.

5. A curtain mounting means as in claim 1 wherein said curtain material is made of a dust barrier material.

6. For use during a construction project at a wall having an unobstructed opening therethrough said opening being defined by exposed edges having front and back sides such as a door or an archway in a building, the combination of a curtain and a mounting means for holding the curtain temporarily over the opening comprising a mounting means having a generally U shaped crossection, said mounting means having resilient legs that are spaced apart a distance for engaging on said front and back sides of said exposed wall edges surrounding said opening, said mounting means being constructed and arranged to be removably engaged over said front and back sides of said wall edges, a plurality of said mounting means being adapted to be mounted on said exposed wall edges to surround said opening, said curtain having a periphery to match the shape of said opening, and coacting engaging means carried by at least the outer surfaces of at least one of the legs of said U shaped mounting means and the periphery of said curtain that can be brought together to hold said curtain in place on said mounting means to hold said curtain over said opening.

7. The combination of a curtain and a mounting means as in claim 6 wherein said mounting means has a resilient outer body and a soft protective inner liner therein.

8. For use during a construction project at a wall having an unobstructed opening therethrough that is defined by exposed side edges of the wall, said edges having front and back sides at a doorway or archway through said wall, the combination of a curtain and a mounting means for holding the curtain temporarily over the opening comprising amounting means including two spaced apart substantially rigid plates, said plates being joined together by at least two pairs of spaced apart bolts to form a body having a U shaped crossection with one of the bolts of each of said pairs of bolts acting as a fulcrum for adjusting said plates to be engaged on said wall edges, said plates forming legs that are spaced apart a distance for engaging on said front and back sides of said exposed wall edges surrounding said opening, said bolts being adapted to be manipulated to engage said plates on said front and back sides of said wall edges that surround said opening, said curtain having a periphery to match the shape of said opening, and coacting engaging means for holding said curtain and said mounting means engaged together to hold the curtain over said opening.

9. The combination as in claim 8 wherein said pairs of bolts are positioned in pairs that are parallel one to the other.

10. The combination as in claim 8 wherein said pairs of bolts are situated with one bolt of each of said pairs spaced closer to the edge of the wall over which the mounting means is being positioned.

11. The combination as in claim 10 wherein the inner most of the bolts in said pairs of bolt acts as a fulcrum when said plates are being adjusted relative to said wall edges.

* * * * *